United States Patent [19]

Walker et al.

[11] Patent Number: 4,946,521

[45] Date of Patent: Aug. 7, 1990

[54] SELECTIVELY ACTIVATED EXPLOSIVE

[75] Inventors: Evan H. Walker, Aberdeen; Warren W. Hillstrom, Bel Air, both of Md.

[73] Assignee: The United States of America as represented by the Secretary of the Army, Washington, D.C.

[21] Appl. No.: 416,791

[22] Filed: Oct. 3, 1989

[51] Int. Cl.[5] ..... C06B 47/08

[52] U.S. Cl. ..... 149/36; 149/46; 149/74; 149/92; 149/109.6

[58] Field of Search ..... 149/46, 74, 92, 109.6, 149/36

[56] References Cited

U.S. PATENT DOCUMENTS

| | | | |
|---|---|---|---|
| 325,538 | 9/1985 | Hayes | 102/477 |
| 375,190 | 12/1987 | Palmer | 102/477 |
| 950,032 | 2/1910 | Stiriz | 102/477 |
| 1,284,032 | 11/1918 | Allen | 102/477 |
| 2,402,552 | 6/1946 | Hopkins | 102/57 |
| 2,929,325 | 3/1960 | Lewis | 102/24 |
| 3,097,119 | 7/1963 | Tyson, Jr. | 149/22 |
| 4,042,431 | 8/1977 | Friant et al. | 149/36 |
| 4,140,059 | 2/1979 | Strandli | 102/57 |
| 4,555,280 | 11/1985 | Levinthal | 149/46 |
| 4,634,480 | 1/1987 | Trocino | 149/74 |
| 4,699,061 | 10/1987 | Jeffers | 102/370 |
| 4,746,380 | 5/1988 | Cooper et al. | 149/46 |

*Primary Examiner*—Stephen J. Lechert, Jr.
*Attorney, Agent, or Firm*—Saul Elbaum; Freda L. Krosnick

[57] ABSTRACT

A binary munition system comprising at least two non-explosive ingredients that combine in flight to form a relatively safe explosive. The combination of said non-explosive ingredients for the purpose of forming safe explosives is novel.

The binary munition stores the non-explosive ingredients in separate compartments which utilize membranes, bags or containers to facilitate the separation. The munition is equipped with means in which to rupture the compartments upon launch or fire. The purpose of the munition is to maintain separation of the non-explosive ingredients and to achieve mixing of the ingredients upon launch or fire of said munition.

13 Claims, 3 Drawing Sheets

SELECTIVELY ACTIVATED EXPLOSIVE

GOVERNMENTAL INTEREST

The invention described herein may be manufactured, used and licensed by or for the U.S. Government for governmental purposes without the payment to us of any royalties thereon.

BACKGROUND OF THE INVENTION

Nitroglycerine, TNT (2,4,8-trinitrotoluene) and mixtures of TNT with RDX (hexahydro-1,3,5-trinitro-1,3,5-triazine) are high explosives which are commonly used in munitions. These materials are volatile and are extremely sensitive to heat, impact, set-back forces and electrical discharge. The sensitive nature of these explosives makes their storage and transport hazardous and difficult. Detonation of munitions containing these high explosives usually causes catastrophic damage. If explosives could be maintained in inert form until the munition is sought to be used, an enormous reduction in accidental losses and losses resulting from enemy fire could be achieved.

High explosives are usually inserted into munitions by melt-cast operations. Any defects in the manner in which said high explosives are loaded into the munitions may lead to catastrophic and premature explosions. Moreover, the storage of these high explosives in ammunition depots, transportation vehicles or combat vehicles make these explosives a ready target for the enemy to demolish munition supplies, equipment and lives. Storage of these munitions contribute as being a major source of equipment and material losses due to enemy fire in wartime. The sensitive nature of these high explosives caused a search to be made to find a means for producing, transporting and storing a relatively "safe" explosive munition.

Intermolecular explosives are not quite as sensitive as the high explosives discussed above; however, they are still too sensitive to avoid the risks outlined.

In the last several years, binary chemical agent systems have been developed in order to provide enhanced safety for chemical agent munitions in the U.S. Army. The technique of using inert binary chemical systems that react to form an explosive after the munition is launched or fired is a concept that can be used to achieve much greater safety for explosive munitions. This technique reduces, and may even eliminate, the hazards of artillery munition handling and transport. The technique is highly effective in eliminating premature detonation of explosive munitions. The increased safety obtained through the use of binary systems further reduces the catastrophic losses of armored vehicles and ships resulting from their being attacked by enemy fire.

Previous binary chemical system munitions designed to achieve mixing of binary explosive ingredients during projectile launch were proposed as early as 1885 by Hayes (U.S. Pat. No. 325,538) and 1887 by Palmer (U.S. Pat. No. 375,190). Both of these patents were based on nitroglycerine being the final explosive product. Due to the volatile nature of nitroglycerine, these munitions must be handled carefully to avoid unintentional leaks and resultant mixing before launch. The invention herein uses non-explosive ingredients which form a product that is a relatively "safe" explosive after mixing, in contrast to the prior art teaching o: nitroglycerin as the formed product. In addition, the present invention does not utilize an external means such as an exterior propeller (note U.S. Pat. No. 325,538), to activate the mixing of the individual component of the binary explosive. Nor does the present invention use the same mixing means described by Palmer (U.S. Pat. No. 375,190).

Another binary chemical system is taught by Strandli (U.S. Pat. No. 4,140,089). Strandli mixes a fuel component and an oxygen donating component. Other than said reference using different non-explosive ingredients, said reference does not use containers, membranes or bags for the storage of the separate ingredients. Moreover, the structure of the projectile does not resemble the munition claimed herein.

Lewis (U.S. Pat. No. 2,929,325) teaches a non-projectile package which contains more than one non-explosive agent. The components used are based on the use of ammonium nitrate and a solid fuel. The final explosive differs from that claimed herein.

Jeffers (U.S. Pat. No. 4,699,061) teaches a binary chemical warhead containing two or more non-toxic reagents which combine to form a lethal agent. The invention therein requires the presence of an injector assembly. The structure of the projectile does not resemble the munition claimed herein.

Hopkins (U.S. Pat. No. 2,402,522), Stiriz (U.S. Pat. No. 950,032), Allen (U.S. Pat. No. 1,284,032) and Tyson, Jr. (U.S. Pat. No. 3,097,119) are cited for additional background material on binary explosive devices.

To date, a binary chemical system using inert ingredients to produce a "safe" explosive upon launch or fire has not been proposed. Moreover, the munition of the type described and claimed herein has further not been proposed.

BRIEF SUMMARY OF INVENTION

This application is filed concurrently with related U.S. application Ser. No. 416,803.

This invention consists of a an explosive comprising at least two non-explosive ingredients which chemically react upon mixing to produce a "safe" explosive. What is meant by the phrase "safe" explosive is that the explosive to be produced, as well as the individual components separated and in the munition, are relatively safe in contrast to the prior art nitroglycerine (which is a product of mixing nitric acid and glycerine) munitions.

This invention further encompasses a munition used to separately house the reactants which form the "safe" explosive discussed above. The munition within the scope of the invention provides a means for the separation and storage of the non-explosive reactants, and further provides a means for mixing the two reactants when wanted. The structure of the munition allows for the complete and thorough mixing of the reactants upon launch or fire.

Munitions that employ the present invention of using inert materials to produce a "safe" explosive eliminate many hazards associated with the storage, transportation and production of munitions. Use of this invention further reduces the vulnerability of storage sites and transportation vehicles. In addition, munitions that employ the present invention can be stored in larger quantities without the use of protective barriers to separate the munitions. The use of protective barriers is costly; and the barriers occupy large areas of space that could be better and more efficiently utilized.

Accordingly, it is an object of the present invention to produce relatively "safe" explosive by the selection and mixing of at least two non-explosive ingredients.

A further object of the invention is to produce a munition to safely house non-explosive ingredients which combine to form an explosive.

A further obJect of the invention is to produce a munition which may be safely stored or transported.

A further object of the invention is to produce a munition which avoids or reduces the likelihood of premature detonation.

Other objectives and features of the present invention will be apparent from the following detailed description of the invention and the claims.

DETAILED DESCRIPTION OF INVENTION

The invention herein is a binary munition system comprising at least two non-explosive ingredients which combine to form a relatively safe explosive. The non-explosive ingredients are readily available commercial materials. Among the non-explosive ingredient combinations within the scope of the present invention are (1) liquid ethylene diamine and liquid nitric acid to form ethylene diamine dinitrate: (2) isopropylamine, hydroxylamine and nitric acid; (3) hydrazine and ammonium nitrate to form hydrazine nitrate; and (4) hydroxylammonium nitrate, triethanolamine nitrate, and water. These non-explosive ingredients are each used in amounts which allow for their combination to form an effective, relatively safe explosive. The specified proportions of the specific components which form the "safe" explosives herein fall within the parameters of (1) 10.0 to 60.0 weight percent liquid ethylene diamine and 90.0 to 40.0 weight percent liquid nitric acid; (2) 5.0 to 30.0 weight percent isopropylamine, 10.0 to 70.0 weight percent hydroxylamine, 30.0 to 70.0 weight percent nitric acid, and 0 to 10.0 weight percent water; (3) 15.0 to 40.0 weight percent hydrazine, 80.0 to 40.0 weight percent ammonium nitrate, and 0 to 20.0 weight percent water; and (4) 40.0 to 90.0 weight percent hydroxylammonium nitrate, 60.0 to 10.0 weight percent triethanolamine nitrate, and 0 to 10.0 weight percent water.

Additives may be used herein in the following manner. To combinations (1) and (2), above, ammonium nitrate may be added to the nitric acid portion. The addition of ammonium nitrate would serve to increase the performance of the final product. Moreover, the addition of glass spheres to any of the non-explosive ingredients in (1) through (4) would sensitize the explosive product. The addition of metallic flakes, such as aluminum flakes, to the amine component of the non-explosive ingredient may be considered in order to disperse the reaction heat formed by the combination of said ingredients. Metallic flakes, other than aluminum flakes, may be used to absorb heat from the reaction product. The metal flakes may be coated with protectant materials such as Teflon. Reaction heat may further be dispersed by the use of endothermic additives, if desired.

Interestingly enough, aqueous solutions of hydroxylammonium nitrate and triethanolamine nitrate are well known liquid propellants (see combination (4) above). When the amount of water present in said propellants is reduced, these propellants may be combined to form a safe explosive. The amount of water affects the sensitivity and energetic output of the individual ingredients as well as the resulting combination of the two. For this combination to be effective for the purpose of this invention, the concentration of water should not exceed 10.0 weight percent, and preferably should not exceed 8.0 weight percent.

Conventional ingredients, such as a hygroscopic agent, may be added to the explosive combinations. With the use of a conventional hygroscopic agent, such as zinc chloride, the presence of water may be increased to 15 weight percent. The hygroscopic agent could be added, for example, to the triethanolamine nitrate (TEAN) solution. This would make it possible to increase the water content, for example, of the hydroxylammonium nitrate (HAN) solution by as much as 5 weight percent. The increase in water content provides an additional safety margin for the hydroxylammonium nitrate component of combination (4) above. Similar benefits can be achieved using conventional thickeners, sensitizers, and gelling agents in place of, or in addition to, a hygroscopic agent.

The safe explosive composition of the present invention is easily made. There is no criticality in the method of mixing said inventive combinations. As a matter of fact, no elaborate mixing means, special conditions or apparatus are required to produce the safe explosive herein. The safe explosive composition may be prepared using conventional mixing techniques. This makes the safe explosive of the present invention relatively simple to make and use.

The invention herein further encompasses the physical structure of a munition that is adapted for its use in binary chemical explosive systems. In the munition, the ingredients are to be kept separated until the munition is launched or fired. The binary munition stores non-explosive ingredients, which combine to form safe explosives, in separate compartments. The separation of the ingredients is facilitated by the use of bags, containers, or encapsulants. Said bags, containers or encapsulants are composed of polymeric materials. Conventional encapsulating and filling techniques are used herein. Among the polymeric materials which may be used are Viton-A (high viscosity fluoroelastomer, produced by E. I. du Pont de Nemours, Wilmington, Del.), polyethylene, nylon, Teflon (tetrafluoroethylene fluorocarbon resins, produced by E. I. du Pont de Nemours & Co., Inc., Wilmington, Del.), and the like. The thickness of the polymeric materials is not critical to this invention so long as the thickness of the materials used function to facilitate separation of the ingredients. For example purposes only, Viton-A film having a thickness of 20 mm may be used herein.

Two techniques for maintaining separation of the non-explosive ingredients and for achieving mixing of the ingredients on firing or launching of the munition are encompassed by this invention. The first of the techniques makes use of container bags which are contained in compartments which run the length of the round of munition and which are located around a central axis of said munition. The container bags may be composed of the polymeric materials discussed above. The second technique uses a conventional munition which has an outer shell and a conventional fuze. Said munition contains at least two non-explosive ingredients which are all kept separate from one another. The ingredients, for example when two are used, are maintained separately by the encapsulation of one of the two ingredients in polymeric materials.

For a further explanation of the invention reference should be made to the discussion below with regard to the accompanying drawings and the embodiments disclosed.

DETAILED DESCRIPTION OF THE DRAWINGS

Figure 1:
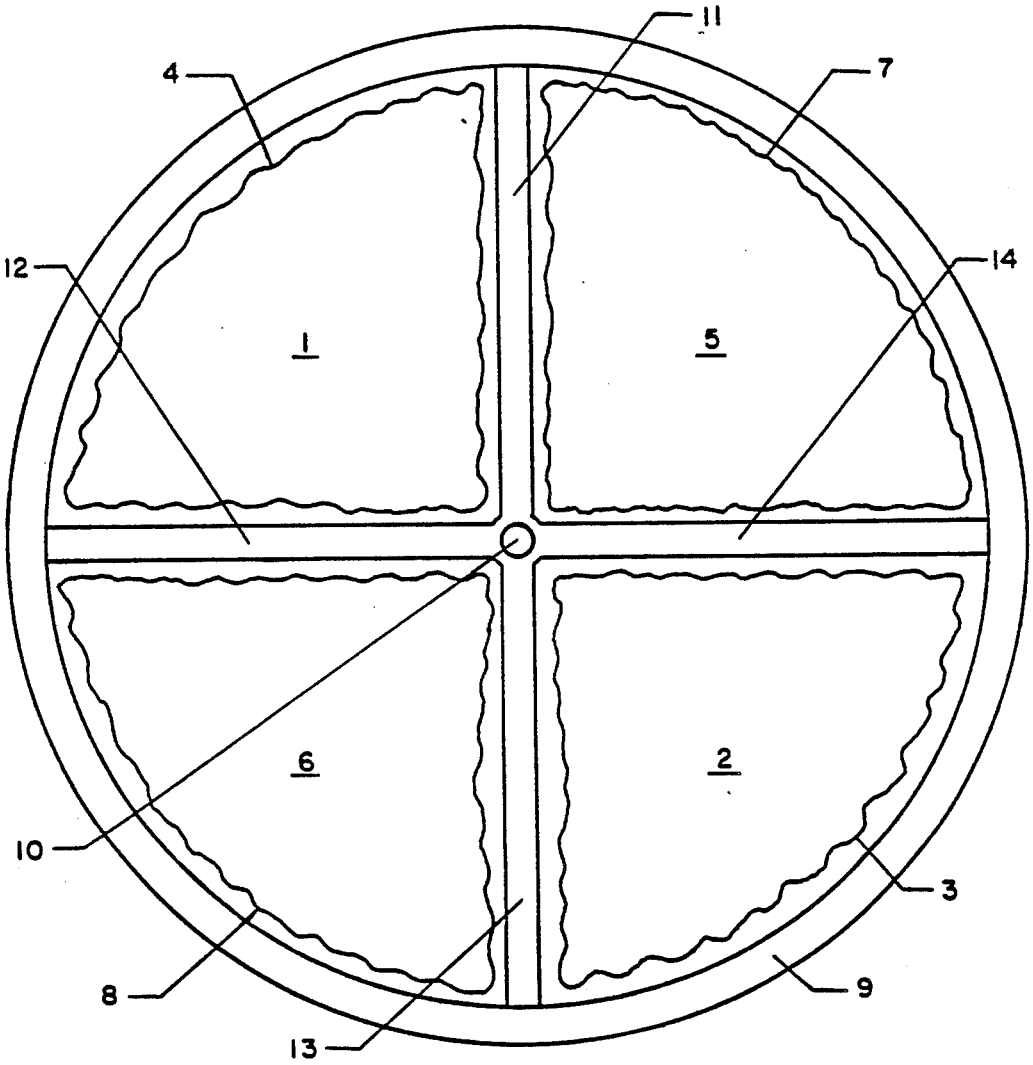
FIG. 1 illustrates a cross-sectional view of the munition of the first technique where four compartments are used in its design.

FIG. 1 illustrates an embodiment of the munition within the scope of this invention. It shows a cross-sectional view of the munition. The munition wall is shown as item (9). Note that four compartments (1), (2), (5) and (6) are used in this particular embodiment. The compartments are located around the central axis rod (10) of the munition, and they run the entire length of the same. Ingredient A, for example ethylene diamine, may be contained in compartments (1) and (2) within bags (3) and (4). Ingredient B, for example nitric acid, may be contained in compartments (5) and (6) within bags (7) and (8). Along the central axis rod (10), are attached vanes (11), (12), (13) and (14). Before launch or fire, these vanes (1), (12), (13) and (14) serve as support walls for the container bags (3), (4), (7) and (8). However, upon launch or fire, the vanes (11), (12), (13) and (14) serve to cut bags (3), (4), (7) and (8) and to stir the released non-explosive ingredients contained in compartments (1), (2), (5) and (6). The vanes (11), (12), (13) and (14) may be fitted with cutting edges or blades to help to effect the opening of container bags (3), (4), (7) and (8). Said vanes (11), (12), (13) and (14) may be composed of steel, aluminum, structural plastics, or the like.

Figure 2:
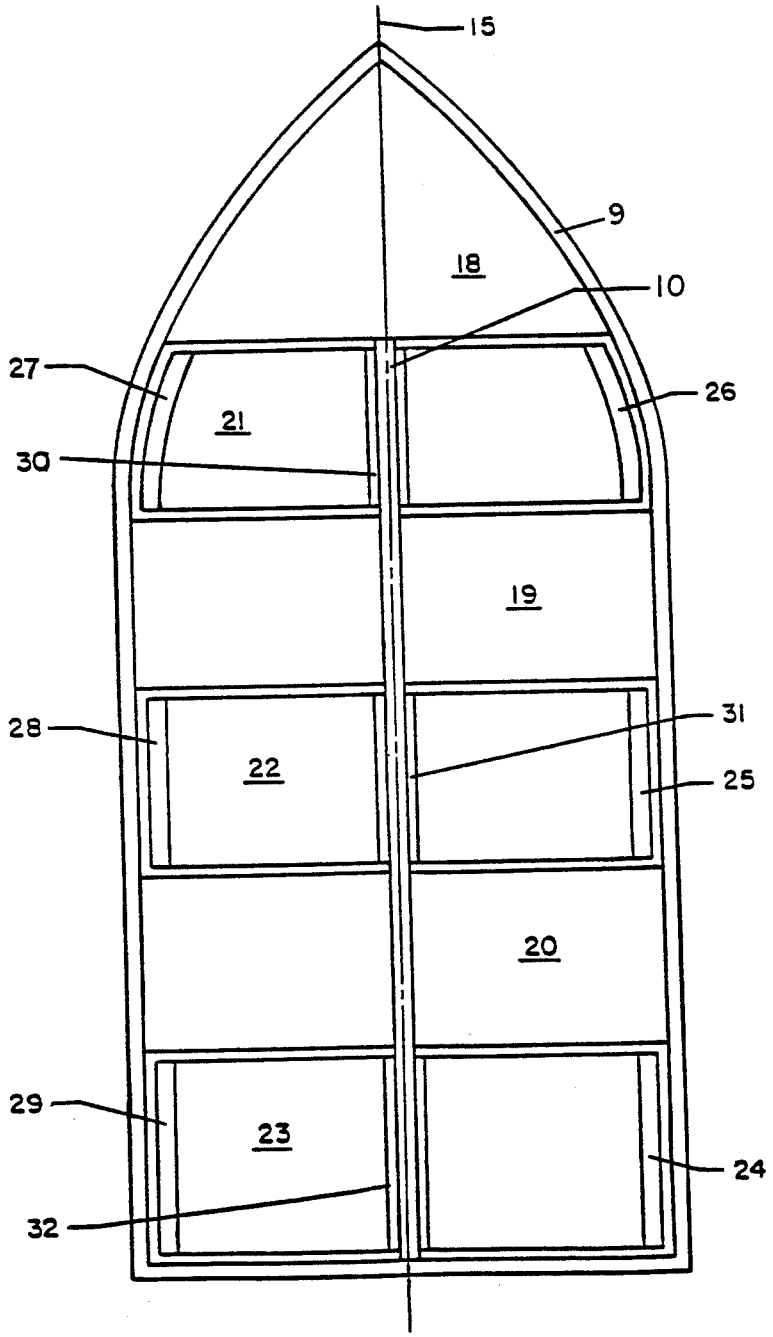
FIG. 2 illustrates the munition of FIG. 1 shown in its lengthwise position.

FIG. 2 further illustrates the technique shown in FIG. 1. In FIG. 2, the munition is illustrated in a lengthwise sectional view therein the center of the munition is labeled (15) and the munition wall (9). The munition contains a conventional fuze (18) located in the upper portion of said munition. The vanes shown as (11), (12), (13) and (14) in FIG. 1 are shown here to consist of stationary stator vanes (19) and (20) which are rigidly attached to the munition wall (9) and central axis rod (10). The vanes as seen in FIG. 1, are further shown here to consist of rotator vanes (21), (22) and (23) which may rotate freely around central axis rod (10). Said rotator vanes (21), (22) and (23) may contain weights (24), (25), (26), (27), (28) and (29) which are attached to the outer-most ends of the rotator vanes. The munition further comprises journal bearings (30), (31) and (32) for the rotator vanes (21), (22) and (23). Rotator vanes (21), (22) and (23) may further be equipped with cutter blades to assist in rupturing the bags (3), (4), (7) and (8) in FIG. 1. Said rotator vanes may optionally be propeller shaped in order to aid in the mixing of the non-explosive ingredients (1), (2), (5) and (6) of FIG. 1 which combine to form a relatively safe explosive.

Figure 3:
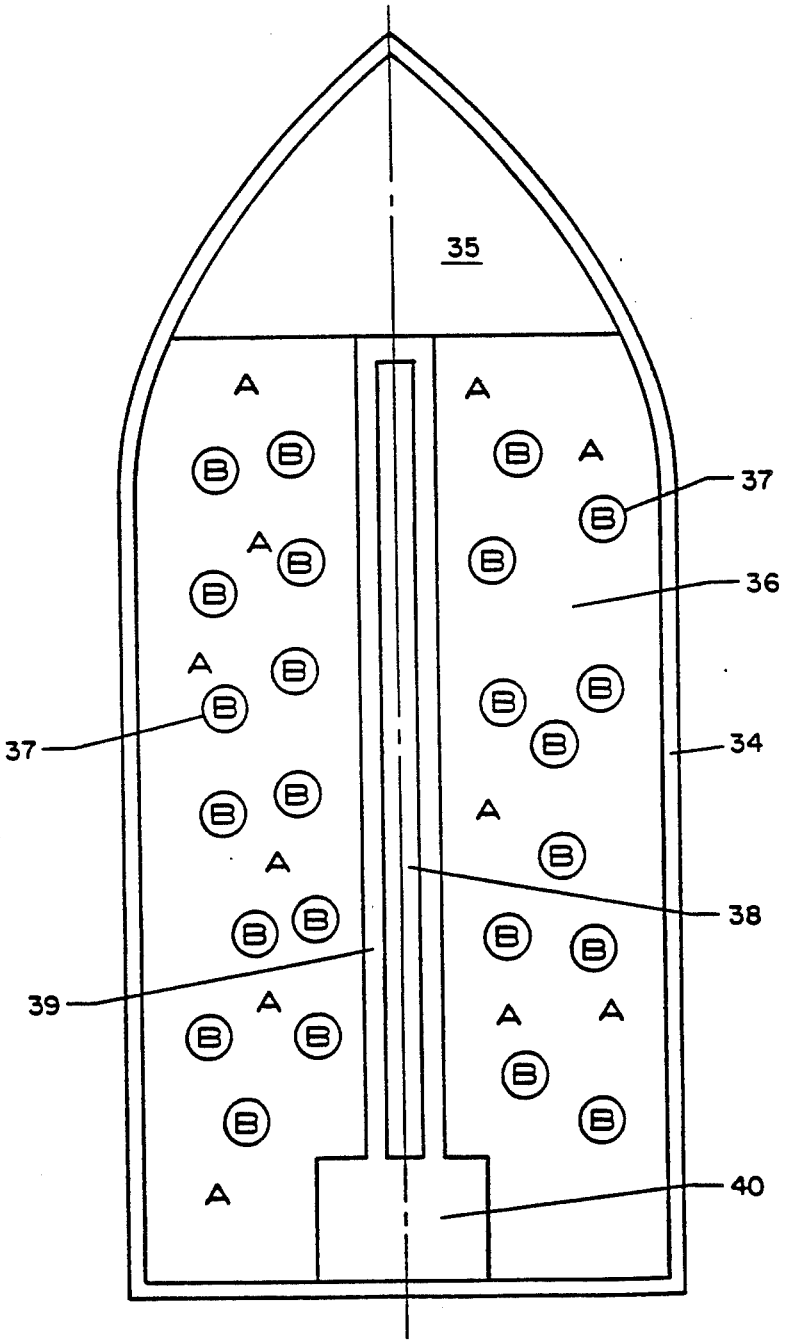
FIG. 3 illustrates a lengthwise position of the munition of the second technique.

FIG. 3 illustrates a lengthwise position of the munition according to the second of the two techniques of the present invention. The Figure shows a conventional munition having an outer shell (34), a conventional fuze (35) and a chamber (36). Said chamber (36) contains two non-explosive ingredients (A) and (B). Non-explosive ingredient (B) is maintained separate from non-explosive ingredient (A) by the use of several polymeric material encapsulants (37). Said chamber (36) surrounds a burster charge which is contained in an axially aligned tube (39). The munition herein further contains a special purpose fuze (40) which fires the burster tube (38) immediately on arming. This special purpose fuze (40) differs from the conventional fuze (35) in that it fires the burster tube (38) on arming, whereas the conventional fuze (35) does not initiate the explosion fill until the munition actually meets the target. For example, when the munition is fired, the set-back forces encountered during launch serve to activate fuze (40) which then causes the burster tube (38) to fire. The firing of the burster tube (38) causes the encapsulated ingredient (B) to be released and allows it to react with ingredient (A). The two ingredients mix during flight. The burster tube (38) contains a sufficiently small amount of explosive material so as to disrupt the encapsulation of ingredient (B) without fracturing the munition outer shell (34).

The embodiments set forth in the figures are merely illustrative of the munition of the present invention. It will be obvious to those skilled in the art that changes and modifications may be made to the munitions without departing from this invention.

SPECIFIC EMBODIMENTS AND EXAMPLES

Example I

Hydroxylammonium nitrate (HAN) and triethanolamine nitrate (TEAN) are readily available non-explosive materials. These ingredients may be combined to form a relatively safe explosive within the scope of the present invention. The presence of water greatly affects the sensitivity of the resulting product. When 72.8 wt. percent of HAN, 23.1 wt. percent of TEAN and 4.1 wt. percent of water are mixed, a relatively safe explosive is produced.

Calculations were made to determine the performance of different HAN and TEAN compositions with varying amounts of water present. The TAMER computer program, which is a computer program used in the evaluation of experimental data, was used to evaluate the performance. The TAMER computer program is a variation on the conventional TIGER program used. The performance is measured through the use of shock velocity (m/sec) and CJ (detonation) pressure (kbars).

TABLE 1

| | | TAMER Calculations | | | |
|---|---|---|---|---|---|
| HAN | TEAN | H2O | Density g/cc | Shock Vel. m/sec. | CJ Press. kbars |
| 63.2 | 20.0 | 16.8 | 1.448 | 8636 | 273 |
| 65.3 | 20.7 | 14.0 | 1.452 | 8657 | 276 |
| 68.4 | 21.6 | 10.0 | 1.520 | 8935 | 308 |
| 72.8 | 23.1 | 4.1 | 1.570 | 9130 | 334 |

From these calculations, one can note that the shock velocity and the detonation pressure begins to increase once the water concentration is reduced to or below 10.0 weight percent. Therefore, a more effective explosive comprising the combination of HAN and TEAN is formed wherein the concentration of water present in said mixture is at or below 10.0 weight percent.

TABLE 2

| Compositions Tested | |
|---|---|
| Mixture 1 | 58.7% wt. HAN; 22.7% wt. TEAN; 18.6% wt. H2O |

TABLE 2-continued

| Compositions Tested | | | |
|---|---|---|---|
| Mixture 2 | 72.8% wt. HAN; | 23.1% wt. TEAN; | 4.1% wt. H2O |
| Mixture 3 | 68.9% wt. HAN; | 21.9% wt. TEAN; | 9.2% wt. H2O |
| Mixture 4 | 70.0% wt. HAN; | 22.1% wt. TEAN; | 7.2% wt. H2O |

The mixtures set forth in Table 2 were tested in plate dent tests. In a plate dent test, a 92 cc sample of the HAN-TEAN explosive is placed in a steel cylinder whose walls have a thickness of 1.27 cm. The steel cylinder has an inner diameter of 5.08 cm and a height of 5.08 cm. A 7.62 cm rolled homogenous armor sheet is placed under the explosive sample. Said explosive is then detonated leaving a dent imprinted into the armor sheet. The depth of the dent is proportional to a pressure-time integral from the sample. The results from the plate dent tests are as follows:

TABLE 3

| Performance of HAN-TEAN-H2O Explosive | |
|---|---|
| Composition | Dent (mm) |
| Mixture 1 | 1.86 |
| Mixture 2 | 8.78 |
| Mixture 3 | 3.10 |
| Mixture 4 | 6.40 |
| Comp. B*(**) | 9.92 |
| 100% TNT(**) | 7.95 |

*60/40 composition of RDX/TNT (RDX = hexahydro-1,3,5-trinitro-1,3,5-triazine)
(**)For comparison purposes only It can be noted that Mixture 2 and Mixture 4, with 4.1 wt. percent water and 7.2 wt. percent water, respectively, perform well. This can additionally be seen in FIG. 4.

The above illustrates the major role in which water plays in the composition of the invention which comprises HAN and TEAN. A greater detonation effect is encountered wherein the water content in said compositions does not exceed 10.0 wt. percent. Moreover the strongest detonation effect is present where the concentration of water in the HAN and TEAN compositions is less than between 7 and 8 wt. percent.

Water does not play such a role in the other non-HAN-TEAN compositions described herein and within the scope of the present invention.

While particular embodiments of the present invention have been shown and described, it will be obvious to those skilled in the art that changes and modifications may be made without departing from this invention . Therefore, it is intended that the claims herein are to include all such obvious changes and modifications as fall within the true spirit and scope of this invention.

We claim:

1. An explosive consisting essentially of an effective amount of non-explosive ingredients which combine upon mixing to produce a safe explosive, wherein said non-explosive ingredients are ethylene diamine and nitric acid.

2. An explosive comprising an effective amount of non-explosive ingredients which combine upon mixing to produce a safe explosive, wherein said non-explosive ingredients are isopropylamine, hydroxylamine and nitric acid.

3. An explosive as set forth in claims 1 or 3, wherein said explosive may further comprise an effective amount of ammonium nitrate to be added to the nitric acid for increased performance of the safe explosive.

4. An explosive comprising an effective amount of non-explosive ingredients which are housed separately and which combine upon mixing to produce a safe explosive, wherein said separately housed, non-explosive ingredients consist essentially of hydrazine and ammonium nitrate.

5. An explosive comprising an effective amount of non-explosive ingredients which combine upon mixing to produce a safe explosive, wherein said non-explosive ingredients are hydroxylammonium nitrate, triethanolamine nitrate and water; said water content in said explosive in less than 10.0 wt. percent.

6. An explosive as set forth in claim 5, comprising 72.8 weight percent hydroxylammonium nitrate, 23.1 weight percent triethanolamine nitrate and 4.1 weight percent water.

7. A method of producing a safe explosive, herein an effective amount of two or more non-explosive ingredients are combined upon firing or launch of a munition separately housing said non-explosives to form an explosive.

8. A method as in claim 7, wherein said non-explosive ingredients are ethylene diamine and nitric acid.

9. A method as in claim 7, wherein said non-explosive ingredients are isopropylamine, hydroxylamine and nitric acid.

10. A method as in claims 8, or 9, wherein an effective amount of ammonium nitrate may be added to the nitric acid for increased performance of the safe explosive.

11. A method as in claim 7, wherein said non-explosive ingredients are hydrazine and ammonium nitrate,

12. A method as in claim 7, wherein said non-explosive ingredients are hydroxylammonium nitrate, triethanolamine nitrate, and water; wherein said water content in said explosive is less than 10.0 wt. percent.

13. A method as in claim 12, wherein said non-explosive ingredients consist of 72.8 wt. percent oxylammonium nitrate, 23.1 wt, percent triethanolamine nitrate and 4.1 wt, percent water.

* * * * *

UNITED STATES PATENT AND TRADEMARK OFFICE

CERTIFICATE OF CORRECTION

PATENT NO. : 4,946,521
DATED : August 7,1990
INVENTOR(S) : Walker et al.

Figure 4:
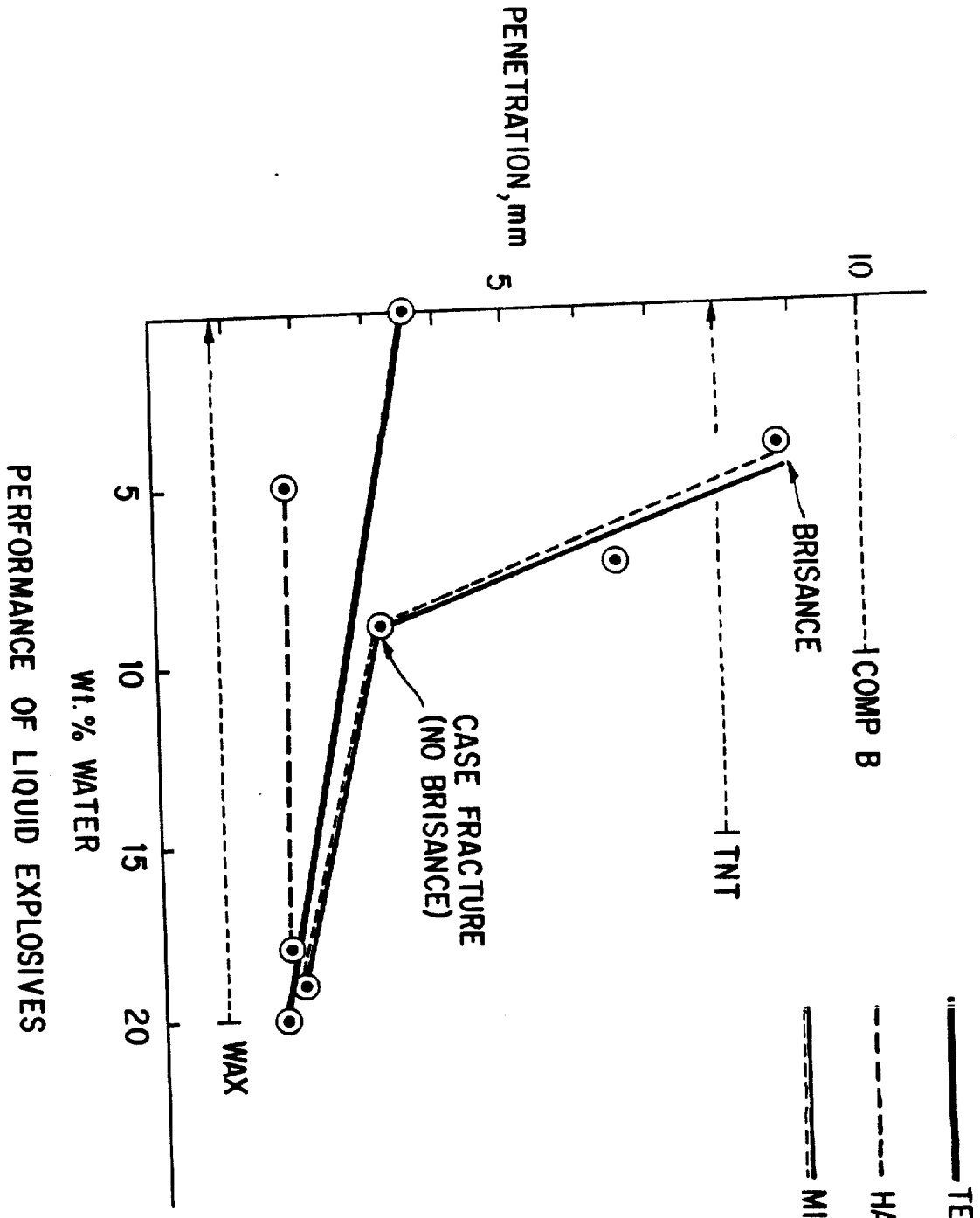
FIG. 4 is a graph illustrating the role in which water plays in a composition of the invention.

It is certified that error appears in the above—identified patent and that said Letters Patent is hereby corrected as shown below:

The sheet of Drawing consisting of Fig. 4, should be added as per attached sheet.

Signed and Sealed this

Twenty-eighth Day of April, 1992

*Attest:*

HARRY F. MANBECK, JR.

*Attesting Officer*

*Commissioner of Patents and Trademarks*

PERFORMANCE OF LIQUID EXPLOSIVES